US008159142B2

(12) United States Patent
Chou et al.

(10) Patent No.: US 8,159,142 B2
(45) Date of Patent: Apr. 17, 2012

(54) BALLAST BEING CAPABLE OF SAVING THE USE OF INTERNAL CONNECTION TERMINALS

(75) Inventors: Ching-Ho Chou, Taoyuan Hsien (TW); Yuan-Yuan Zhong, Shanghai (CN); Wei-Qiang Zhang, Shanghai (CN); Jian-Ping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 785 days.

(21) Appl. No.: 12/233,054

(22) Filed: Sep. 18, 2008

(65) Prior Publication Data

US 2009/0261752 A1 Oct. 22, 2009

(30) Foreign Application Priority Data

Apr. 21, 2008 (TW) ..... 97114433 A

(51) Int. Cl.

| | |
|---|---|
| ***H05B 37/02*** | (2006.01) |
| ***H05B 39/04*** | (2006.01) |
| ***H05B 41/36*** | (2006.01) |
| *H05B 41/16* | (2006.01) |
| *H05B 41/24* | (2006.01) |
| *H05B 37/00* | (2006.01) |
| *H05B 39/00* | (2006.01) |
| *H05B 41/00* | (2006.01) |
| *G05F 1/00* | (2006.01) |

(52) U.S. Cl. ..... 315/210; 315/209 R; 315/250; 315/283; 315/291; 315/294; 315/312

(58) Field of Classification Search ..... None
See application file for complete search history.

(56) References Cited

U.S. PATENT DOCUMENTS

| | | | | |
|---|---|---|---|---|
| 6,788,001 | B2 * | 9/2004 | Lechner | 315/94 |
| 7,336,040 | B2 * | 2/2008 | Zeng | 315/224 |
| 2005/0156534 | A1 * | 7/2005 | Oh | 315/247 |

FOREIGN PATENT DOCUMENTS

JP 2007087711 A * 4/2007

* cited by examiner

*Primary Examiner* — Douglas W Owens
*Assistant Examiner* — Dedei K Hammond
(74) *Attorney, Agent, or Firm* — Holland & Knight, LLP; Brian J. Colandreo, Esq.; Jeffrey T. Placker, Esq.

(57) ABSTRACT

A ballast comprising a first input terminal, a second input terminal, a switch circuit, and a plurality of lamp sets is provided. The switch circuit comprises a first switch and a second switch connected with the first one. The switches are connected with the first and second input terminals respectively. The lamp sets are connected in parallel with each other and have an arrangement sequence. Each of the lamp sets is coupled to the first and second switches and comprises a first lamp having a first filament. The filaments are connected in series according to the arrangement order so that at least one junction is formed in the at least one connection point. The first one of the first filaments is coupled to the first switch. The last one of the first filaments is coupled to the second switch. Thereby, the ballast can be implemented by less internal connection terminals and leads.

18 Claims, 12 Drawing Sheets

BALLAST BEING CAPABLE OF SAVING THE USE OF INTERNAL CONNECTION TERMINALS

RELATED APPLICATION

This application claims the benefit of priority based on Taiwan Patent Application No. 097114433 filed on Apr. 21, 2008, the disclosure of which is incorporated herein by reference in its entirety.

BACKGROUND OF THE INVENTION

1. Field of the Invention

The present invention relates to a ballast. More specifically, the present invention relates to a ballast that can save the use of internal connection terminals.

2. Descriptions of the Related Art

Lamps have been used in more and more widespread applications since the advent thereof. One of the most widespread and well-known applications is lighting. As people are looking for better lighting qualities, a lighting equipment is usually equipped with many lamps rather than one lamp.

FIG. 1 illustrates a schematic diagram of the conventional ballast 1 comprising a plurality of lamps. The ballast 1 comprises a first lamp set 11, a second lamp set 13, a switch circuit, and direct current (DC) input terminals 171, 172. The switch circuit comprises capacitors 151, 152 and switches e.g. Mosfet 153, 154. The first lamp set 11 comprises a resonant circuit 111, a plurality of preheat circuits 112, 113, 114, and a plurality of lamps 115, 116. The second lamp set 13 comprises a resonant circuit 131, a plurality of preheat circuits 132, 133, 134, and a plurality of lamps 135, 136. Uses and functionalities of the elements of the ballast 1 are well known to those skilled in the art, thus only those relevant to the present invention will be described herein.

The first lamp set 11 and the second lamp set 13 are connected in parallel. A filament of the lamp 116 of the first lamp set 11 is connected to a filament of the lamp 136 of the second lamp set 13 at a node 14, and the node 14 can be considered as a junction for parallel connection. FIG. 2 illustrates connections between the lamps 116, 136 and internal/output (I/O) terminals of the ballast 1. Particularly, connection wires 12*a*, 12*b*, 12*c*, 12*d*, 12*e* are required for the connection of the lamps 116, 136 within the ballast 1. Meantime, nine I/O terminals (i.e. the nine blocks with small circle in FIG. 2) and connection wires 11*a*, 11*b*, 11*c* are further required for connection with the ballast. Such complex connections inevitably increase manufacturing cost of and space occupation within the ballast 1.

In summary, efforts still have to be made in the art to provide a ballast that can save the use of internal connection terminals, wires, and internal space.

SUMMARY OF THE INVENTION

One objective of the present invention is to provide a ballast. A connection manner of the internal electronic components of the ballast may save the use of internal connection terminals, wires and internal space.

To this end, the ballast of the present invention comprises a first input terminal, a second input terminal, a switch circuit, and a plurality of lamp sets. The switch circuit comprises a first switch and a second switch. A first terminal of the first switch is connected to the first input terminal, a second terminal of the first switch is connected to a first terminal of the second switch, and a second terminal of the second switch is connected to the second input terminal. The lamp sets are connected to each other in parallel and have an arrangement sequence. Each of the lamp sets is coupled to the first switch and the second switch. Each of the lamp sets comprises a lamp including a filament. The filaments are connected in series according to the arrangement sequence to form at least one junction at the series connection point. The first one of the filaments is coupled to the first switch and the last one of the filaments is coupled to the second switch, so that the at least one junction is connected to the switch circuit indirectly via a portion of the first filaments.

By changing the connection manner of the lamps and the preheat circuits, the ballast of the present invention saves the use of internal/output terminals and wires so as to free more internal space within the ballast. Therefore, the problem that a conventional ballast uses too many internal connection terminals and wires is effectively overcome.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the present invention will be explained with reference to embodiments thereof. However, these embodiments are not intended to limit that the present invention can only be embodied in any specific context, applications, or with particular methods described in these embodiments. Therefore, description of these embodiments is only intended to illustrate rather than to limit the present invention. It should be noted that, in the following embodiments and the attached drawings, elements indirectly related to the present invention are omitted from illustration, and relationships among individual elements are only illustrated to facilitate understanding rather than to limit the actual scales.

Figure 1:
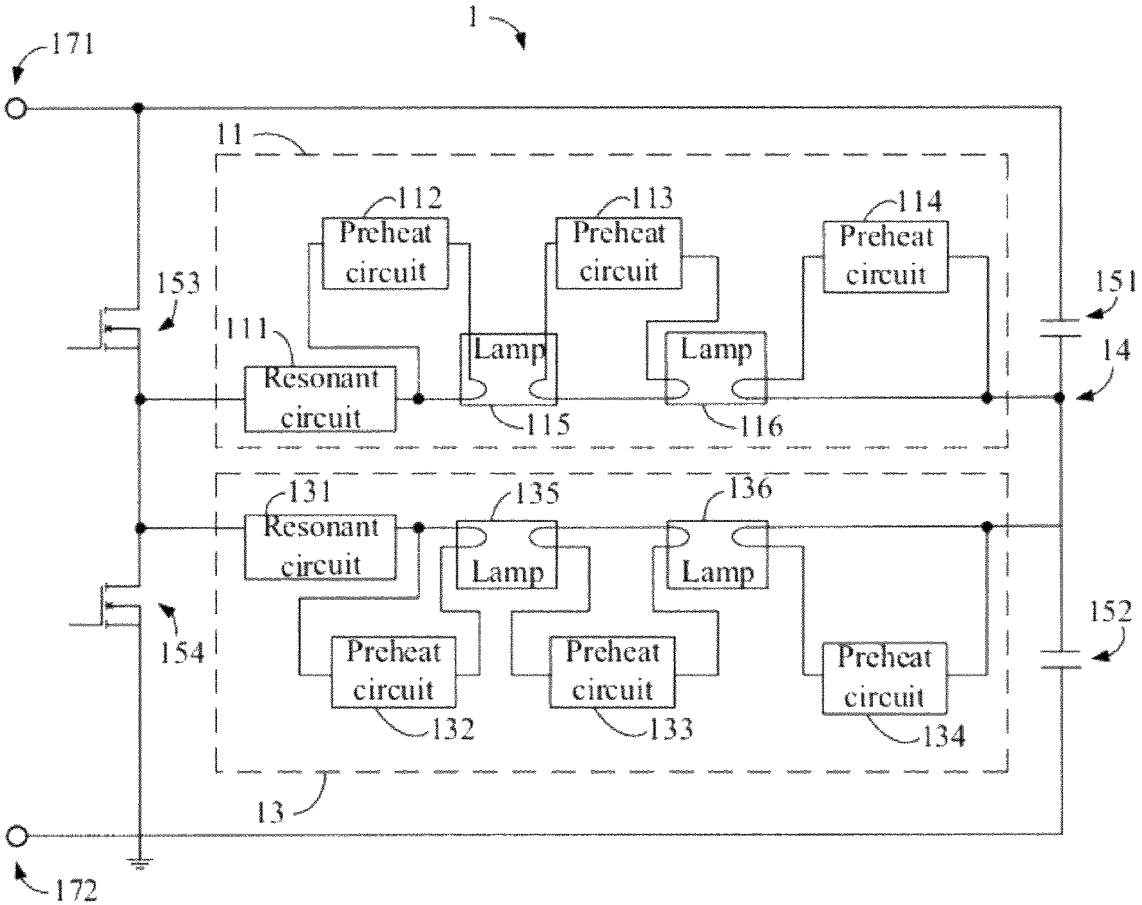
FIG. 1 (Prior Art)
FIG. 1 is a schematic view of a conventional ballast.
Figure 2:
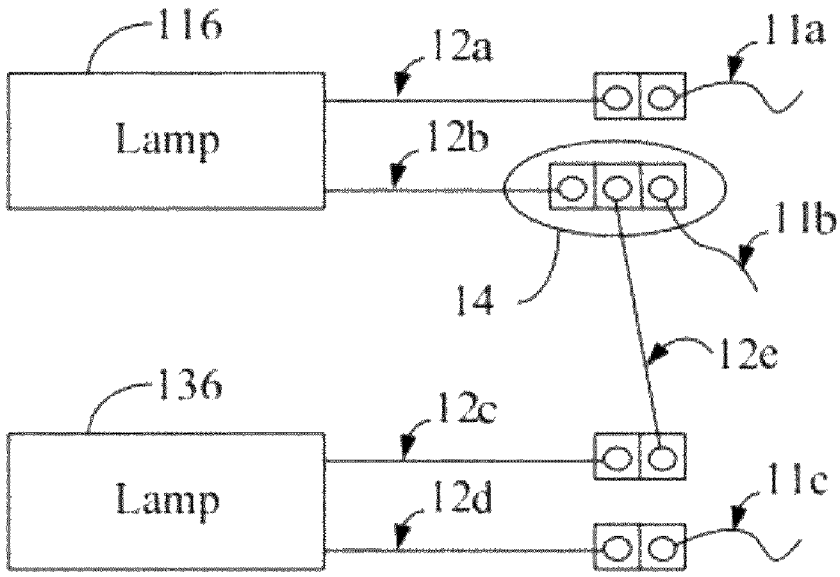
FIG. 2 (Prior Art)
FIG. 2 is a schematic view illustrating connections between lamps and I/O terminals.
Figure 3:
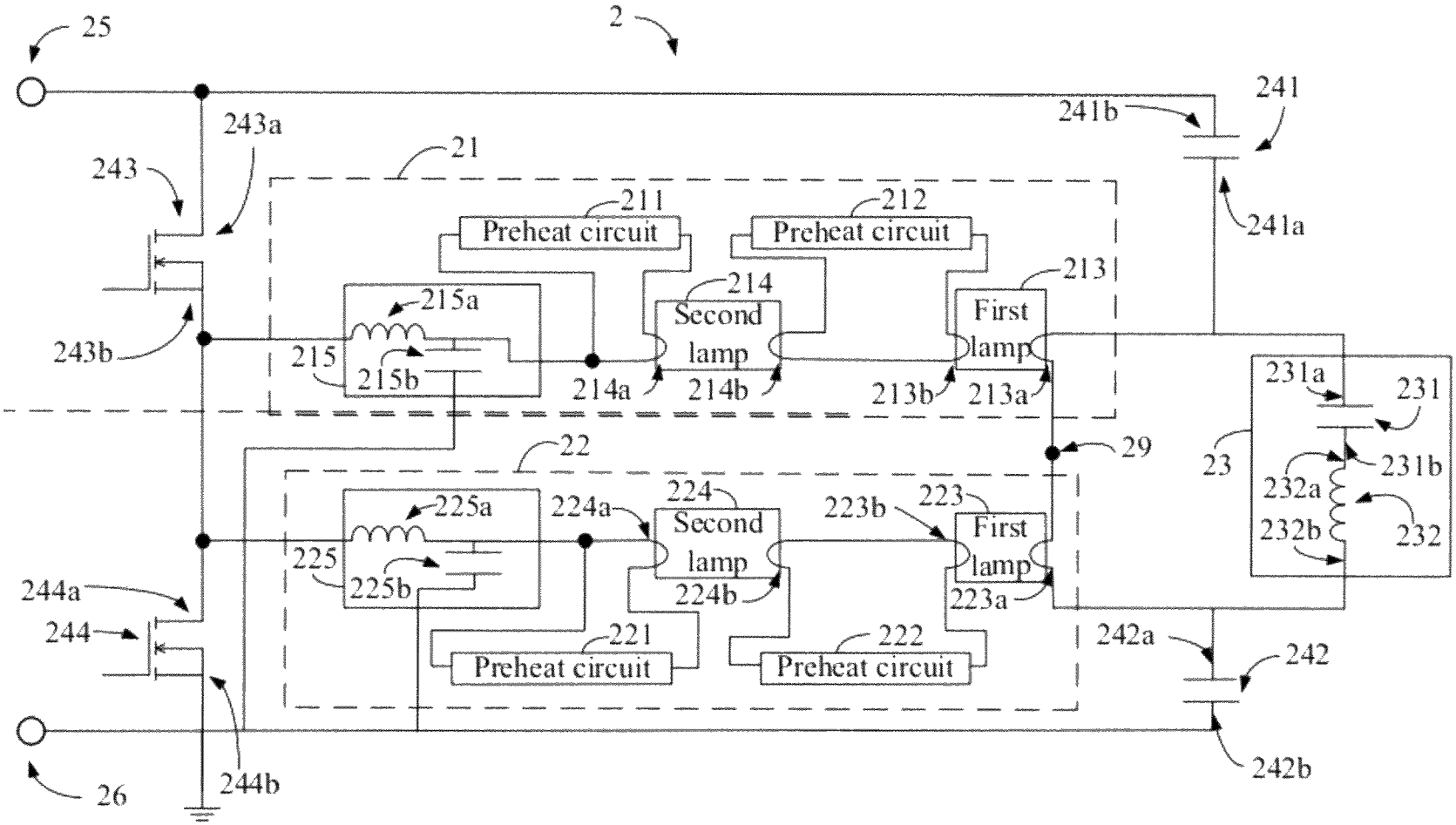
FIG. 3 is a schematic view of a first preferred embodiment of the present invention.

FIG. 3 illustrates a first preferred embodiment of the present invention, which is a ballast 2. The ballast 2 comprises a switch circuit, a first lamp set 21, a second lamp set 22, a preheat circuit 23, a first input terminal 25, and a second input terminal 26. The first input terminal 25 and the second input terminal 26 are configured to receive a direct current.

The switch circuit comprises a first capacitor 241, a second capacitor 242, a first switch 243, and a second switch 244. The first capacitor 241 has a first terminal 241*a* and a second terminal 241*b*; the second capacitor 242 has a first terminal 242*a* and a second terminal 242*b*; the first switch 243 has a first terminal 243*a* and a second terminal 243*b*; and the second switch 244 has a first terminal 244*a* and a second terminal 244*b*. The first terminal 243*a* of the first switch 243 is connected to the first input terminal 25, the second terminal 243*b* of the first switch 243 is connected to the first terminal 244*a* of the second switch 244, and the second terminal 244*b* of the second switch 244 is connected to the second input terminal 26. The second terminal 241*b* of the first capacitor 241 is connected to the first terminal 243*a* of the first switch 243, and the second terminal 242*b* of the second capacitor 242 is connected to the second terminal 244*b* of the second switch 244.

The first lamp set 21 and the second lamp set 22 are connected to each other in parallel. The first lamp set 21 and the second lamp set 22 are both coupled to the first capacitor 241, the second capacitor 242, the first switch 243, the second switch 244, the preheat circuit 23, the first input terminal 25, and the second input terminal 26 for normal operation. Individual elements of the ballast 2 and connections therebetween will be described particularly hereinafter. It should be noted that, although the ballast 2 of this preferred embodiment comprises only two lamp sets, the ballast of other embodiments may comprise other numbers of lamp sets connected to each other in parallel. In other words, the number of the lamp sets is not intended to limit the present invention.

Next, individual elements of the first lamp set 21 and the second lamp set 22 and connections therebetween will be described. The first lamp set 21 comprises a first lamp 213, a second lamp 214, a resonant circuit 215, and preheat circuits 211, 212. The first lamp 213 has a first filament 213*a* and a second filament 213*b*, and the second lamp 214 has a first filament 214*a* and a second filament 214*b*.

The first filament 214*a* of the second lamp 214 is connected to the resonant circuit 215 and the second filament 214*b* of the second lamp 214 is connected to the second filament 213*b* of the first lamp 213, so that the resonant circuit 215, the second lamp 214, and the first lamp 213 are connected in series. Particularly, the resonant circuit 215 comprises a resonant inductor 215*a* and a resonant capacitor 215*b*, and both of them are coupled to the first filament 214*a* of the second lamp 214. Hence, the resonant circuit 215 is able to start the first lamp 213 and the second lamp 214 of the first lamp set 21. The preheat circuit 211 is connected with the resonant circuit 215 and the first filament 214*a* of the second lamp 214 to preheat the first filament 214*a* before the second lamp 214 is started. The preheat circuit 212 is connected between the second filament 213*b* of the first lamp 213 and the second filament 214*b* of the second lamp 214 to preheat the second filaments 213*b*, 214*b* before the first lamp 213 and the second lamp 214 are started.

The second lamp set 22 comprises a first lamp 223, a second lamp 224, a resonant circuit 225, and preheat circuits 221, 222. The first lamp 223 has a first filament 223*a* and a second filament 223*b*, and the second lamp 224 has a first filament 224*a* and a second filament 224*b*. The first filament 224*a* of the second lamp 224 is connected to the resonant circuit 225 and the second filament 224*b* of the second lamp 224 is connected to the second filament 223*b* of the first lamp 223, so that the resonant circuit 225, the second lamp 224, and the first lamp 223 are connected in series. The resonant circuit 225 comprises a resonant inductor 225*a* and a resonant capacitor 225*b*, and both of them are coupled to the second filament 224*a* of the second lamp 224. Hence, the resonant circuit 225 is able to start the first lamp 223 and the second lamp 224 of the second lamp set 22. The preheat circuit 221 is connected with the resonant circuit 225 and the first filament 224*a* of the second lamp 224 to preheat the first filament 224*a* before the second lamp 224 is started. The preheat circuit 222 is connected between the second filament 223*b* of the first lamp 223 and the second filament 224*b* of the second lamp 224 to preheat the second filaments 223*b*, 224*b* before the first lamp 223 and the second lamp 224 are started.

Functions of the resonant circuits 215, 225 in the ballast 2 are well-known to those skilled in the art and thus will not be described herein. Additionally, the resonant circuit 215 of the first lamp set 21 and the resonant circuit 225 of the second lamp set 22 are both connected to the first switch 243 and the switch 244.

The first lamp set 21 and the second lamp set 22 are connected to each other in parallel and have an arrangement sequence: the first lamp set 21 and the second lamp set 22 in sequence. The first filaments 213*a*, 223*a* are connected in series according to the arrangement sequence. Particularly, the first filament 213*a* is connected to the first terminal 241*a* of the first capacitor 241, the first filament 223*a* is connected to the first filament 213*a*, and the first terminal 242*a* of the second capacitor 242 is connected to the first filament 223*a*. By having such a series connection, a junction 29 is formed at the series connection point. It should be emphasized that, the junction 29 is indirectly connected to the switch circuit (e.g., the first capacitor 241 and the second capacitor 242) via the first filaments 213*a*, 223*a*. That is, with such a connection scheme, the first lamp set 21 and the second lamp set 22 are coupled to the first switch 243 via the first capacitor 241 and coupled to the second switch 244 via the second capacitor 242.

The preheat circuit 23 comprises a preheat capacitor 231 and an inductor 232. The preheat capacitor 231 has a first terminal 231*a* and a second terminal 231*b*, and the inductor 232 has a first terminal 232*a* and a second terminal 232*b*. The inductor 232 and the preheat capacitor 231 are connected in series. Specifically, the first terminal 232*a* of the inductor 232 is connected to the second terminal 231*b* of the preheat capacitor 231; the second terminal 232*b* of the inductor 232 is connected to the first terminal 242*a* of the second capacitor 242; and the first terminal 231*a* of the preheat capacitor 231 is connected to the first terminal 241*a* of the first capacitor 241. To be more specific, the first terminal 231*a* of the preheat capacitor 231 of the preheat circuit 23 is connected to the first filament 213*a* (i.e., the first one of the first filaments 213*a*, 223*a*), and the second terminal 232*b* of the inductor 232 of the preheat circuit 23 is connected to the first filament 223*a* (i.e., the last one of the first filaments 213*a*, 223*a*). It should be noted that, although the preheat circuit 23 of this preferred embodiment comprises only one inductor, it may comprise other numbers of inductors in other preferred embodiments; in other words, the number of the inductors are not intended to limit the preheat circuit 23 of the present invention.

Figure 4:
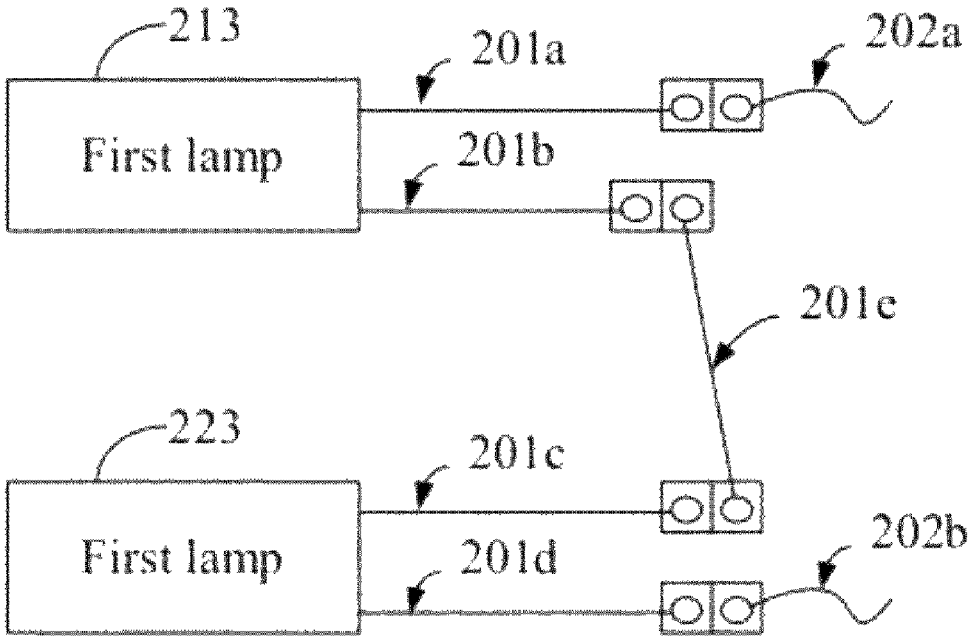
FIG. 4 is a schematic view illustrating connection of internal connection terminals of the ballast of the present invention.

FIG. 4 illustrates the connection between the first lamps 213, 223 and the I/O terminals of the ballast. Wires 201*a*, 201*b*, 201*c*, 201*d*, 201*e* are required for the connection of the first lamps 213, 223 in the ballast 2; however, only eight I/O terminals (the eight blocks having a small circle therein respectively in FIG. 4) and only wires 202*a*, 202*b* are further required for connection with the ballast. This effectively cuts down the manufacturing cost of the ballast and reduces the use of internal space therein.

Figure 5:
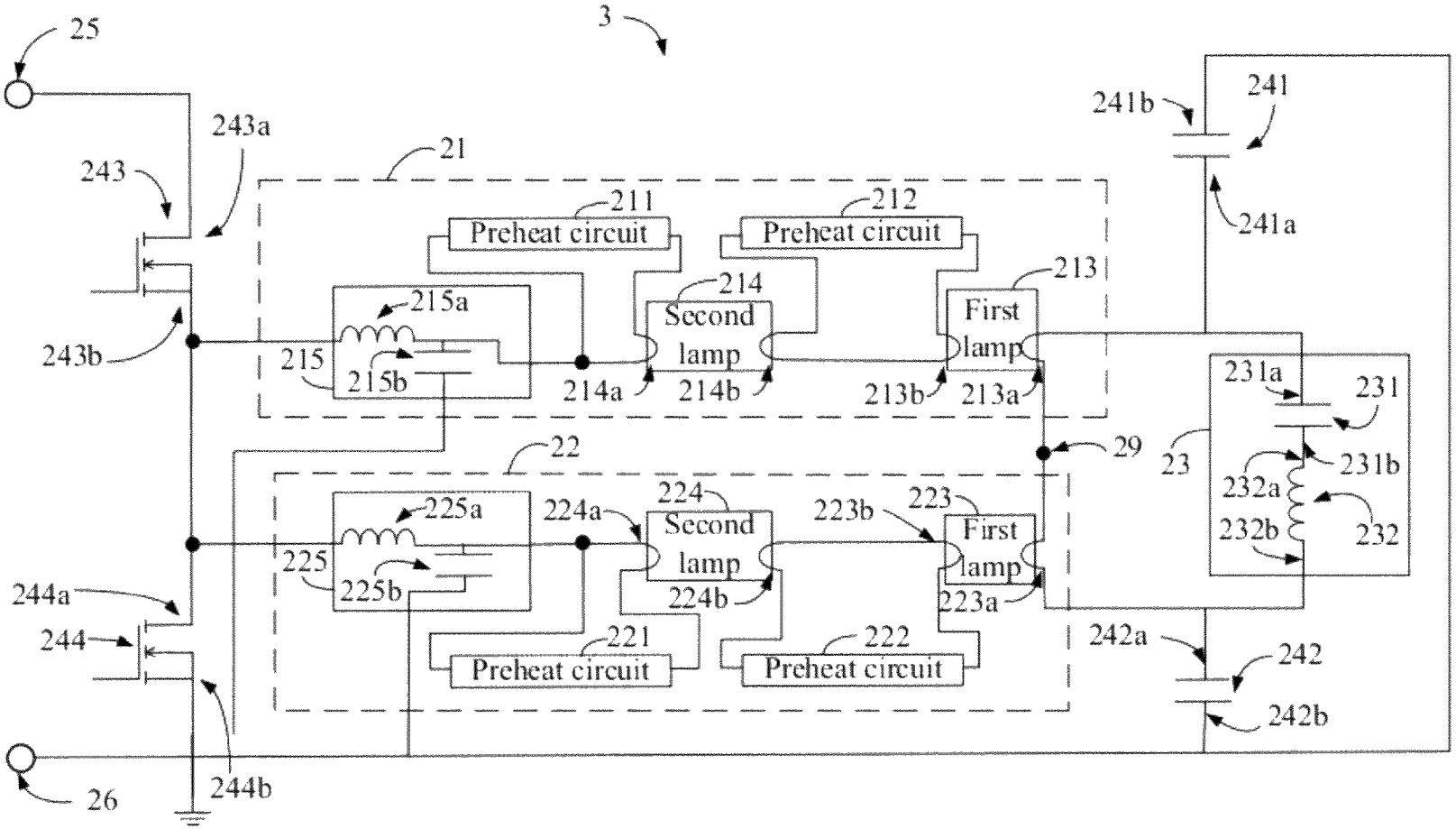
FIG. 5 is a schematic view of a second preferred embodiment of the present invention.

A second preferred embodiment of the present invention is illustrated in FIG. 5, which is a schematic view of a ballast 3. The ballast 3 is different from the ballast 2 in respect of the switch circuit. The following description will focus on differences between the ballast 3 and the ballast 2, with identical portions thereof being omitted from description.

The switch circuit of the ballast 3 comprises a first capacitor 241, a second capacitor 242, a first switch 243, and a second switch 244. The ballast 3 is different from the ballast 2 in respect of connection of the first capacitor 241. Specifically, the second terminal 241*b* of the first capacitor 241 of the ballast 3 is connected to the second terminal 242*b* of the second capacitor 242 and the second switch 244 instead of the first switch 243. The connections between the switch circuit and other elements of the ballast 3 make the ballast 3 have the same functions as the ballast 2. Upon reviewing description of the ballast 2 of the first preferred embodiment, those skilled in the art is able to appreciate that the first lamps 213, 223 of the ballast 3 also have the same properties as those illustrated in FIG. 4, and thus this will not be described again herein.

Figure 6:
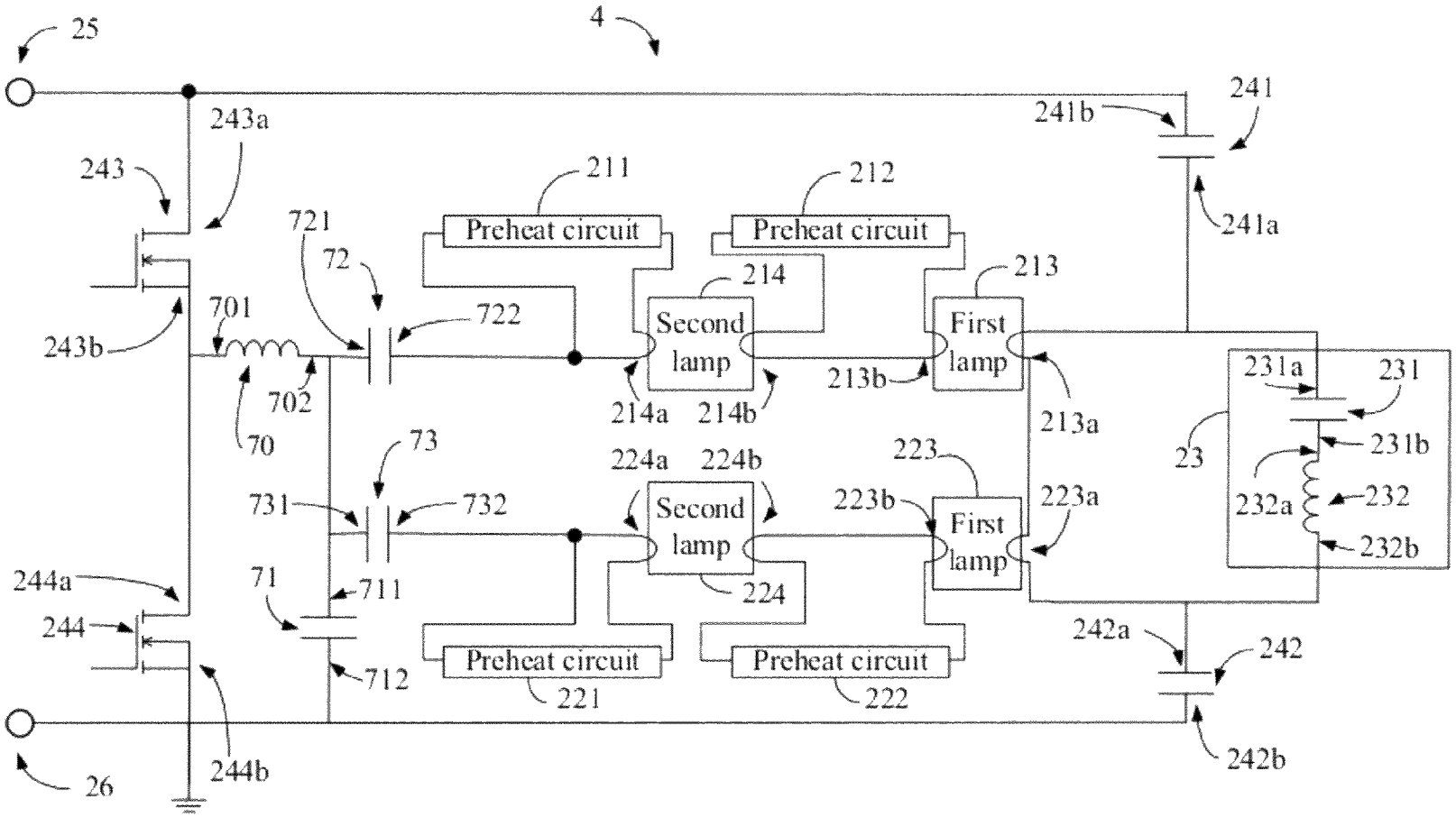
FIG. 6 is a schematic view of a third preferred embodiment of the present invention.

A third preferred embodiment of the present invention is illustrated in FIG. 6, which is a schematic view of a ballast 4. The ballast 4 comprises a switch circuit, a first lamp set, a second lamp set, a preheat circuit 23, a first input terminal 25, and a second terminal 26. The first lamp set comprises a first lamp 213, a second lamp 214, a resonant circuit, and preheat circuits 211, 212. The second lamp set comprises a first lamp 223, a second lamp 224, a resonant circuit, and preheat circuits 221, 222. The ballast 4 is different from the ballast 2 in respect of connection points and connection manners of the resonant circuits. The following description will focus on differences between the ballast 4 and the ballast 2, and descriptions of their identical portions are omitted.

In this embodiment, the resonant circuit of the first lamp set comprises a common resonant inductor 70, a common resonant capacitor 71, and an independent resonant capacitor 72. The resonant circuit of the second lamp set comprises a common resonant inductor 70, a common resonant capacitor 71, and an independent resonant capacitor 73.

Specifically, the common resonant inductor 70 has a first terminal 701 and a second terminal 702, wherein the first terminal 701 of the common resonant inductor 70 is connected to the second terminal 243*b* of the first switch 243 and the first terminal 244*a* of the second switch 244. The common resonant capacitor 71 has a first terminal 711 and a second terminal 712. The first terminal 711 of the common resonant capacitor 71 is connected to the second terminal 702 of the common resonant inductor 70. The second terminal 712 of the common resonant capacitor 71 is connected to the second terminal 242*b* of the second capacitor 242 and the second input terminal 26. The first terminal 721 of the independent resonant capacitor 72 is connected to the second terminal 702 of the common resonant inductor 70 and the first terminal 711 of the common resonant capacitor 71. The second terminal 722 of the independent resonant capacitor 72 is connected to the first lamp set. By having the connections, the resonant circuit comprising the common resonant inductor 70, the common resonant capacitor 71, and the independent resonant capacitor 72 has properties similar to those of the resonant circuit 215 of the ballast 2.

In addition, the first terminal 731 of the independent resonant capacitor 73 is connected to the second terminal 702 of the common resonant inductor 70 and the first terminal 711 of the common resonant capacitor 71. The second terminal 732 of the independent resonant capacitor 73 is connected to the second lamp set 22. By having the connections, the resonant circuit comprising the common resonant inductor 70, the common resonant capacitor 71, and the independent resonant capacitor 73 has properties similar to those of the resonant circuit 225 of the ballast 2.

In other words, the first and second lamp sets of the ballast 4 differ from the first lamp set 21 and the second lamp set 22 of the ballast 2 in that the resonant circuits of the first and second lamp sets of the ballast 4 comprises the common resonant inductor 70, the common resonant capacitor 71, and respectively independent resonant capacitors 72, 73 to provide the same properties as the resonant circuits 215, 225 of the ballast 2. Upon reviewing description of the above embodiments, those skilled in the art may readily appreciate that the first lamps 213, 223 of the ballast 4 of the preferred embodiment also have the same properties as those illustrated in FIG. 4, and thus this will not be described again herein.

Figure 7:
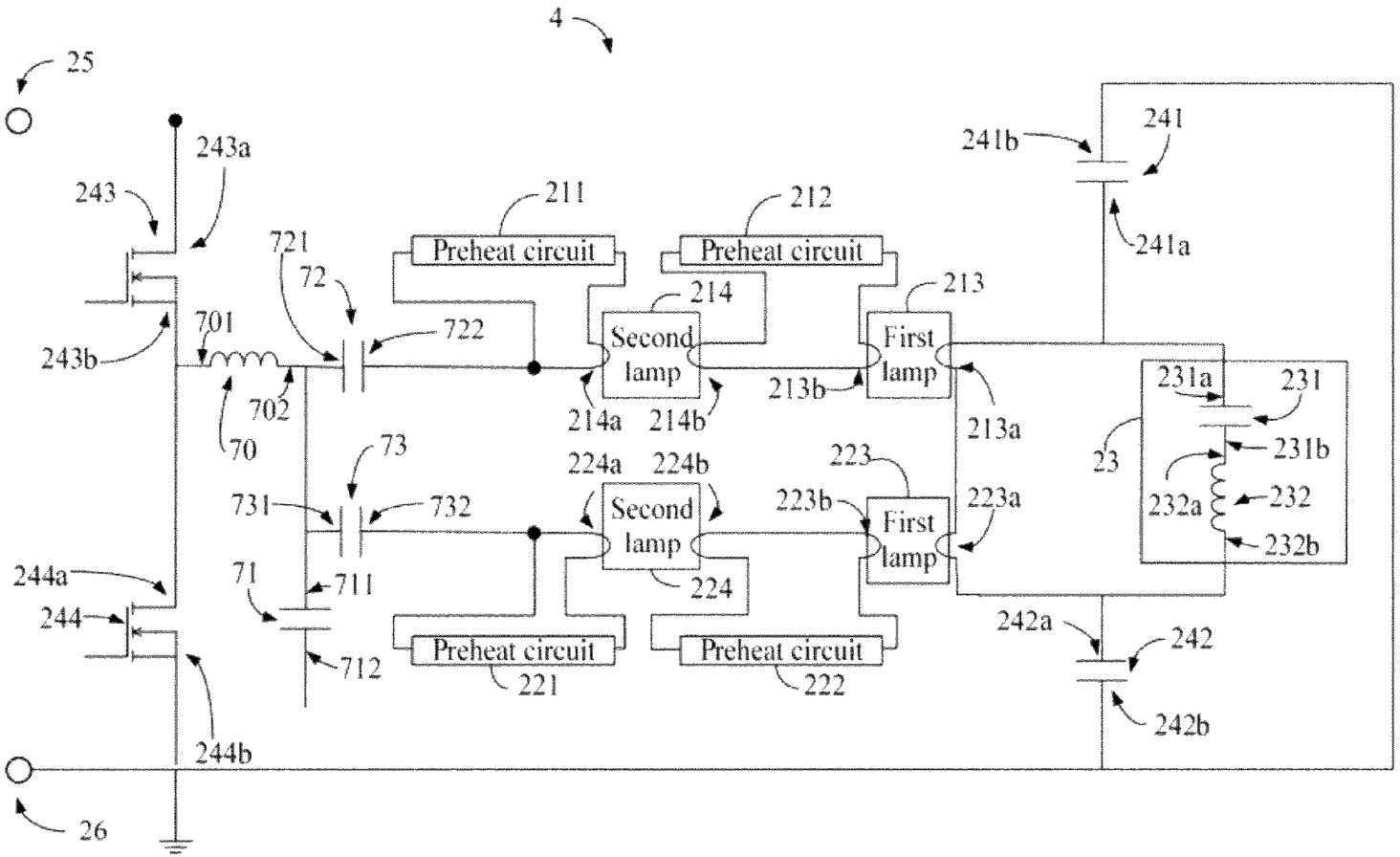
FIG. 7 is a schematic view of a fourth preferred embodiment of the present invention.

A fourth preferred embodiment of the present invention is illustrated in FIG. 7, which is a schematic view of a ballast 5. The ballast 5 is different from the ballast 4 in respect of the switch circuit. The following description will focus on differences between the ballast 5 and the ballast 4, and descriptions of their identical portions are omitted.

The switch circuit of the ballast 5 comprises a first capacitor 241, a second capacitor 242, a first switch 243, and a second switch 244. The ballast 5 is different from the ballast 4 in respect of connection of the first capacitor 241. Specifically, the second terminal 241*b* of the first capacitor 241 of the ballast 5 is connected to the second terminal 242*b* of the second capacitor 242 and the second switch 244 instead of the first switch 243. The connections between the switch circuit and other elements of the ballast 5 make the ballast 5 have the same functions and properties as that of the ballast 4. Upon reviewing description of the ballast 4 of the third preferred embodiment, those skilled in the art may readily appreciate that the first lamps 213, 223 of the ballast 5 also have the same functions and properties as those illustrated in FIG. 4, and thus this will not be described again herein.

Figure 8:
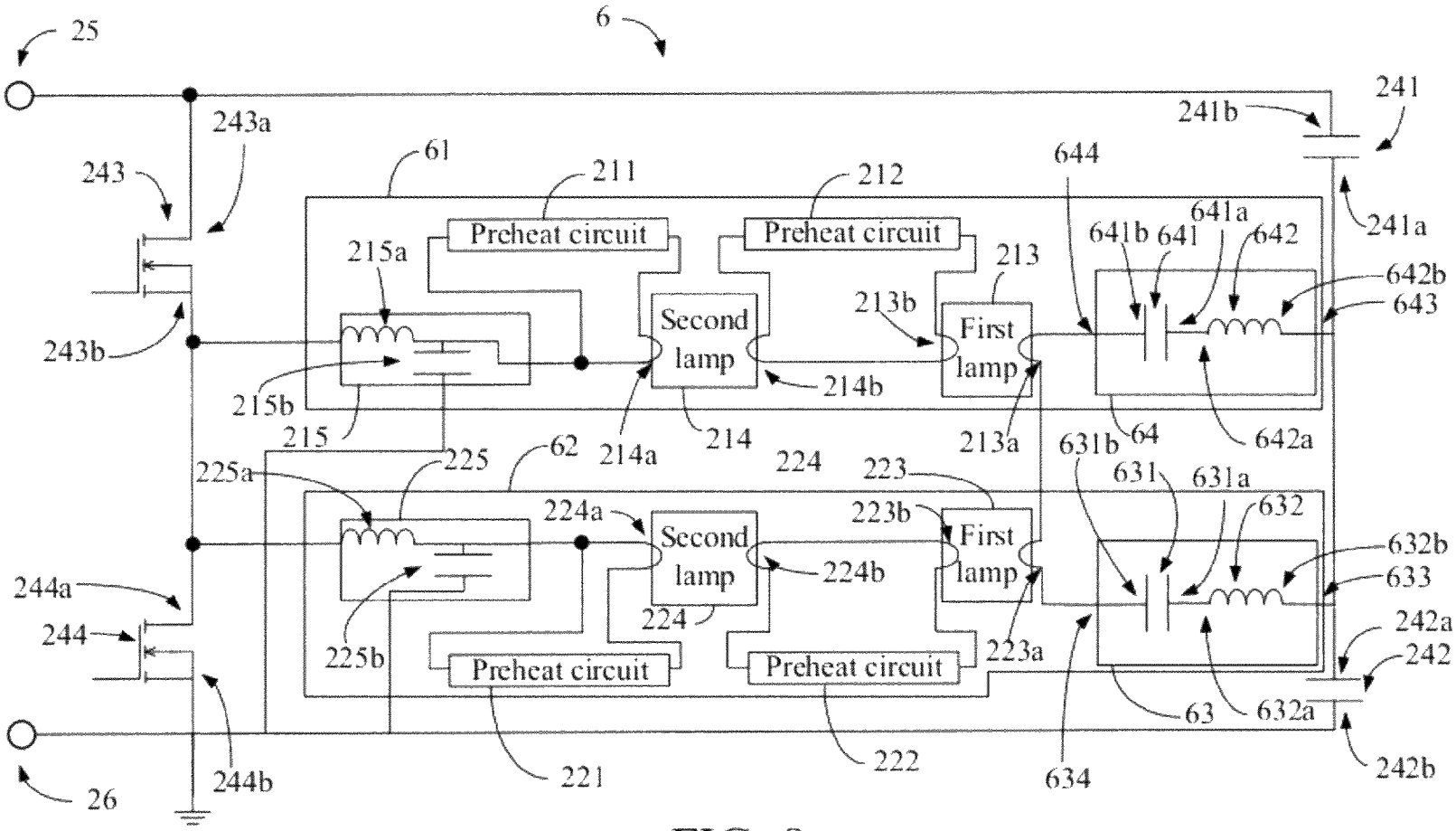
FIG. 8 is a schematic view of a fifth preferred embodiment of the present invention.

A fifth preferred embodiment of the present invention is illustrated in FIG. 8, which is a schematic view of a ballast 6. The ballast 6 is different from the ballast 2 of the first preferred embodiment in respect of the connections between the lamp sets and the preheat circuits. The following description will focus on the differences between the ballast 6 and the ballast 2, and descriptions of their identical portions will be omitted.

The ballast 6 of this preferred embodiment comprises a switch circuit, a first lamp set 61, and a second lamp set 62 but without the preheat circuit 23. The ballast 6 differs from the ballast 2 in that the first lamp set 61 comprises a preheat circuit 64 in addition to a first lamp 213, a second lamp 214, a resonant circuit 215, and preheat circuits 211, 212. Likewise, the second lamp set 62 comprises a preheat circuit 63 in addition to a first lamp 223, a second lamp 224, a resonant circuit 225, and preheat circuits 221, 222. In other words, the preheat circuit 23 of the ballast 2 is substituted by the preheat circuits 63, 64 of the ballast 6. A description will be made on connections between the preheat circuits 64, 63 and other electronic components of the ballast 6 hereinbelow.

Similarly, the first lamp set 61 and the second lamp set 62 are connected to each other in parallel and have an arrangement sequence. The arrangement sequence is: the first lamp set 61 and then the second lamp set 62 in sequence. The preheat circuit 64 (i.e., the preheat circuit of the first one of the lamp sets) is coupled to the first switch 243, and the preheat circuit 63 (i.e., the preheat circuit of the last one of the lamp sets) is coupled to the second switch 244. The preheat circuit 64 of the first lamp set 61 has a first terminal 643 and a second terminal 644. The first terminal 643 is connected to the first terminal 241*a* of the first capacitor 241 and the first terminal 242*a* of the second capacitor 242, and the second terminal 644 is connected to the first filament 213*a* of the first lamp 213. Furthermore, the preheat circuit 64 comprises a preheat capacitor 641 and an inductor 642. The preheat capacitor 641 has a first terminal 641*a* and a second terminal 641*b*, and the inductor 642 has a first terminal 642*a* and a second terminal 642*b*. The first terminal 642*a* of the inductor 642 is connected to the first terminal 641*a* of the preheat capacitor 641. The preheat circuit 64 is connected to the first lamp set 61, the first capacitor 241, and the second capacitor 242 in the following manner: the second terminal 641*b* of the preheat capacitor 641 is connected to the first filament 213*a* of the first lamp 213, the second terminal 642*b* of the inductor 642 is connected to the first terminal 241*a* of the first capacitor 241 and the first terminal 242*a* of the second capacitor 242. In other embodiments, the preheat circuit 64 may be connected to the first lamp set 61, the first capacitor 241 and the second capacitor 242 in the following manner instead: the second terminal 642*b* of the inductor 642 is connected to the first filament 213*a* of the first lamp 213 and the second terminal 641*b* of the preheat capacitor 641 is connected to the first terminal 241*a* of the first capacitor 241 and the first terminal 242*a* of the second capacitor 242.

Likewise, the preheat circuit 63 has a first terminal 633 and a second terminal 634. The first terminal 633 is connected to the first terminal 241*a* of the first capacitor 241 and the first terminal 242*a* of the second capacitor 242, and the second terminal 634 of the preheat circuit 63 is connected to the first filament 223*a* of the first lamp 223. Particularly, the preheat circuit 63 comprises a preheat capacitor 631 and an inductor 632. The preheat capacitor 631 has a first terminal 631*a* and a second terminal 631*b*, and the inductor 632 has a first terminal 632*a* and a second terminal 632*b*. The first terminal 632*a* of the inductor 632 is connected to the first terminal 631*a* of the preheat capacitor 631. The preheat circuit 63 is connected to the first lamp 223, the first capacitor 241, and the second capacitor 242 in a following manner: the second terminal 631*b* of the preheat capacitor 631 is connected to the first filament 223*a* of the first lamp 223, and the second terminal 632*b* of the inductor 632 is connected to the first terminal 241*a* of the first capacitor 241 and the first terminal 242*a* of the second capacitor 242.

In other embodiments, the preheat circuit 63 may be connected to the first lamp 223, the first capacitor 241, and the second capacitor 242 in a following manner instead: the second terminal 632*b* of the inductor 632 is connected to the first filament 223*a* of the first lamp 223, and the second terminal 631*b* of the preheat capacitor 631 is connected to the first terminal 241*a* of the first capacitor 241 and the first terminal 242*a* of the second capacitor 242. It should be noted that, the preheat circuits 63, 64 do not have to be equipped in the ballast 6 at the same time in other embodiments. In other words, the aforementioned operations and functions of the ballast 6 may also be accomplished under presence of only a single one of the preheat circuits 63, 64, which can be readily appreciated by those skilled in the art and thus will not further described herein.

Those skilled in the art may also readily appreciate that the first lamps 213, 223 of the ballast 6 may also provide the same functions and properties as those illustrated in FIG. 4, and this will not be further described herein.

Figure 9:
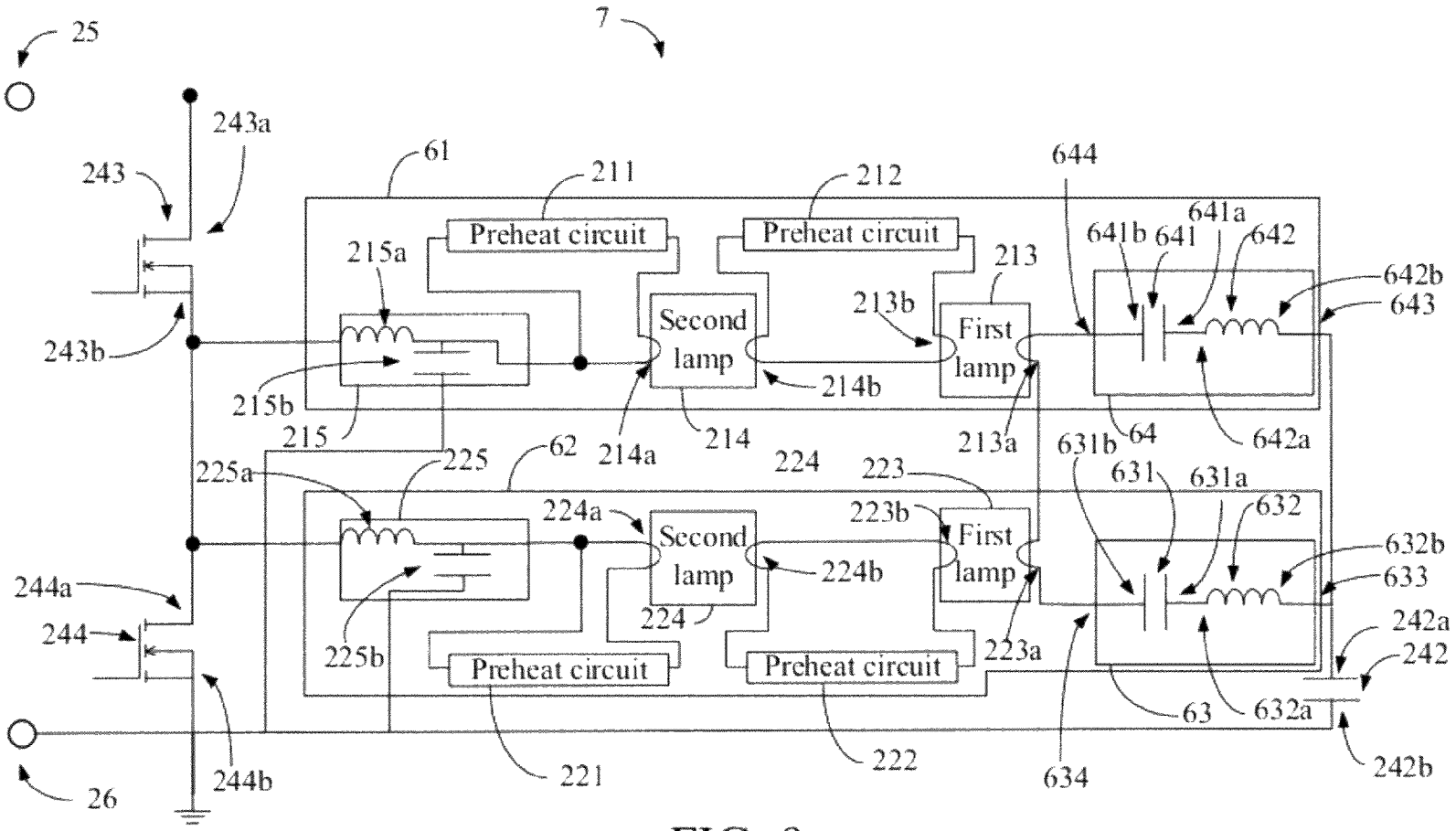
FIG. 9 is a schematic view of a sixth preferred embodiment of the present invention.

A sixth preferred embodiment of the present invention is illustrated in FIG. 9, which is a schematic view of a ballast 7. The ballast 7 is different from the ballast 6 in respect of the switch circuit. The following description will focus on differences between the ballast 7 and the ballast 6, and descriptions related to their identical portions are omitted.

Specifically, the ballast 7 of this preferred embodiment differs from the ballast 6 of the fifth preferred embodiment in that the switch circuit of the ballast 7 comprises the first switch 243, the second switch 244, and the second capacitor 242 but does not comprise the first capacitor 241. Nevertheless, the ballast 7 still provides the same functions and properties as the ballast 6. Upon reviewing description of the ballast 6, those skilled in the art may readily appreciate that the first lamps 213, 223 of the ballast 7 is able to provide the same functions and properties as those illustrated in FIG. 4, and this will not be further described herein.

It should be emphasized that, it is unnecessary to provide both the preheat circuits 63, 64 in the ballast 7 at the same time in other embodiments. In other words, the aforementioned operations and functions of the ballast 7 is able to be accomplished under the presence of only one of the preheat circuits 63, 64, which can be readily appreciated by those skilled in the art upon reviewing description of the ballast 6 and thus will not further described herein.

Figure 10:
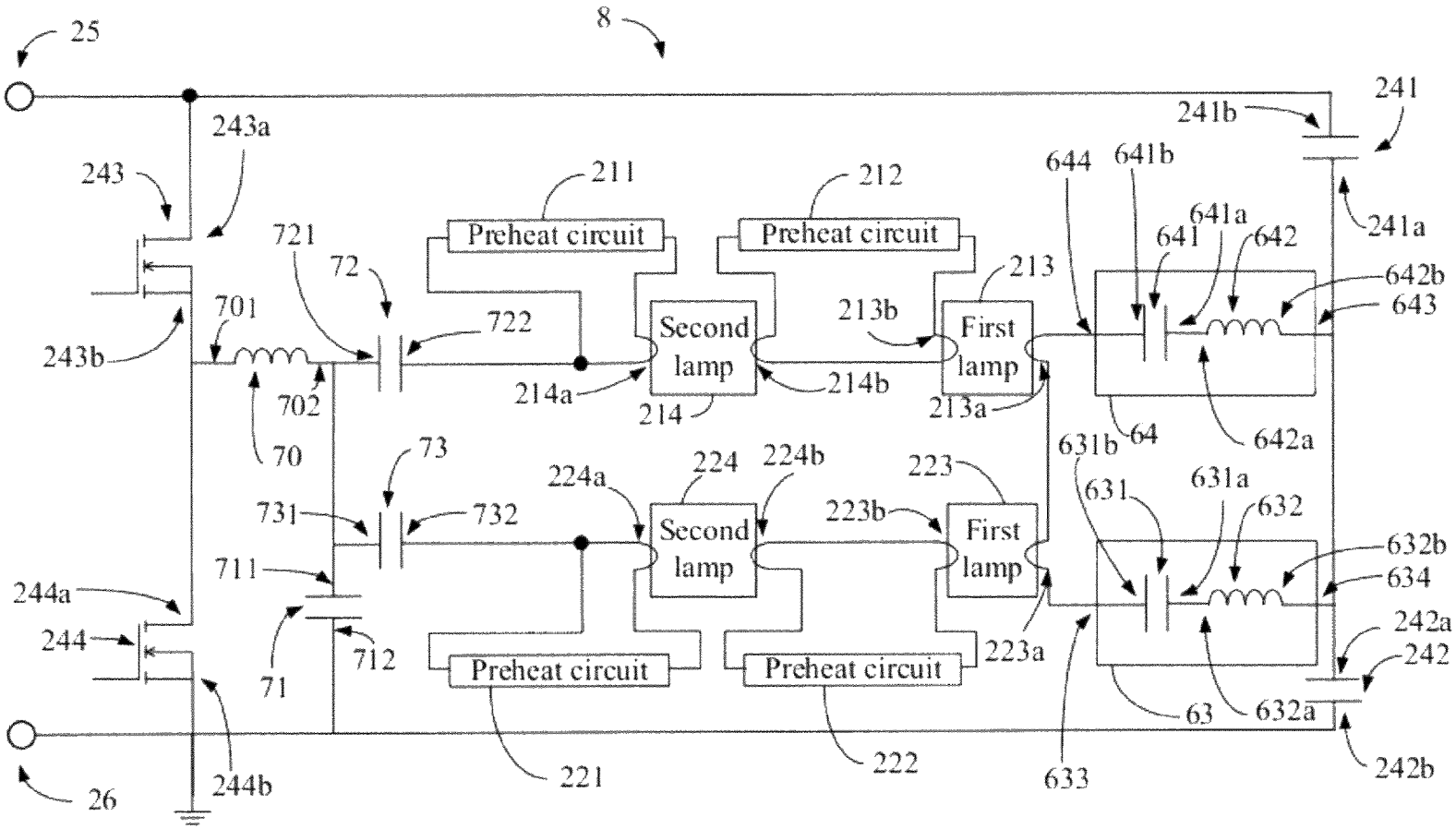
FIG. 10 is a schematic view of a seventh preferred embodiment of the present invention.

A seventh preferred embodiment of the present invention is illustrated in FIG. 10, which is a schematic view of a ballast 8. The ballast 8 comprises a switch circuit, a first lamp set, and a second lamp set as well. The first lamp set comprises a first lamp 213, a second lamp 214, a resonant circuit, and preheat circuits 211, 212, 64. The second lamp set comprises a first lamp 223, a second lamp 224, a resonant circuit, and preheat circuits 221, 222, 63. The ballast 8 is different from the ballast 6 in respect of connection points and connection manners of the resonant circuits. The following description will focus on differences between the ballast 8 and the ballast 6, and descriptions related to their identical portions are omitted.

In this preferred embodiment, the resonant circuit of the first lamp set of the ballast 8 comprises a common resonant inductor 70, a common resonant capacitor 71, and an independent resonant capacitor 72. The resonant circuit of the second lamp set comprises a common resonant inductor 70, a common resonant capacitor 71, and an independent resonant capacitor 73.

Specifically, the common resonant inductor 70 has a first terminal 701 and a second terminal 702, wherein the first terminal 701 is connected to the second terminal 243*b* of the first switch 243 and the first terminal 244*a* of the second switch 244. The common resonant capacitor 71 has a first terminal 711 and a second terminal 712. The first terminal 711 of the common resonant capacitor 71 is connected to the second terminal 702 of the common resonant inductor 70. The second terminal 712 of the common resonant capacitor 71 is connected to the second terminal 242*b* of the second capacitor 242 and the second input terminal 26. The first terminal 721 of the independent resonant capacitor 72 is connected to the second terminal 702 of the common resonant inductor 70 and the first terminal 711 of the common resonant capacitor 71. The second terminal 722 of the independent resonant capacitor 72 is connected to the first lamp set. By having the connection relations, the resonant circuit comprising the common resonant inductor 70, the common resonant capacitor 71, and the independent resonant capacitor 72 has the same functions and properties as the resonant circuit 215 of the ballast 6 has.

In addition, the first terminal 731 of the independent resonant capacitor 73 is connected to the second terminal 702 of the common resonant inductor 70 and the first terminal 711 of the common resonant capacitor 71. The second terminal 732 of the independent resonant capacitor 73 is connected to the second lamp set. By having the connection relations, the resonant circuit comprising the common resonant inductor 70, the common resonant capacitor 71, and the independent resonant capacitor 73 has the same functions and properties as the resonant circuit 225 of the ballast 6 has.

In other words, the first and second lamp sets of the ballast 8 differ from the first lamp set 61 and the second lamp set 62 of the ballast 6 in that the resonant circuits of the first and second lamp sets of the ballast 8 uses the common resonant inductor 70 and the common resonant capacitor 71 commonly and the independent resonant capacitors 72, 73 respectively to provide the same functions and properties as the resonant circuits 215, 225 of the ballast 6. Upon reviewing description of the above embodiments, those skilled in the art may readily appreciate that the first lamps 213, 223 of the ballast 8 of the preferred embodiment also provide the same functions as those illustrated in FIG. 4, and thus this will not be described again herein.

It should be emphasized that, it is unnecessary to provide both the preheat circuits 63, 64 in the ballast 8 at the same time in other embodiments. In other words, the aforementioned operations and functions of the ballast 8 can be accomplished under presence of only a single one of the preheat circuits 63, 64, which can be readily appreciated by those skilled in the art upon reviewing description of the above embodiments and thus will not further described herein.

Although all of the aforementioned ballasts 2, 3, 4, 5, 6, 7, 8 comprise only two lamp sets (i.e., the first and second lamp sets) individually, the ballast may also comprise more than two lamp sets in other examples, where each lamp set has the similar structure and connecting manner and the first filament of the first lamp in each ballast are connected in series.

Figure 11:
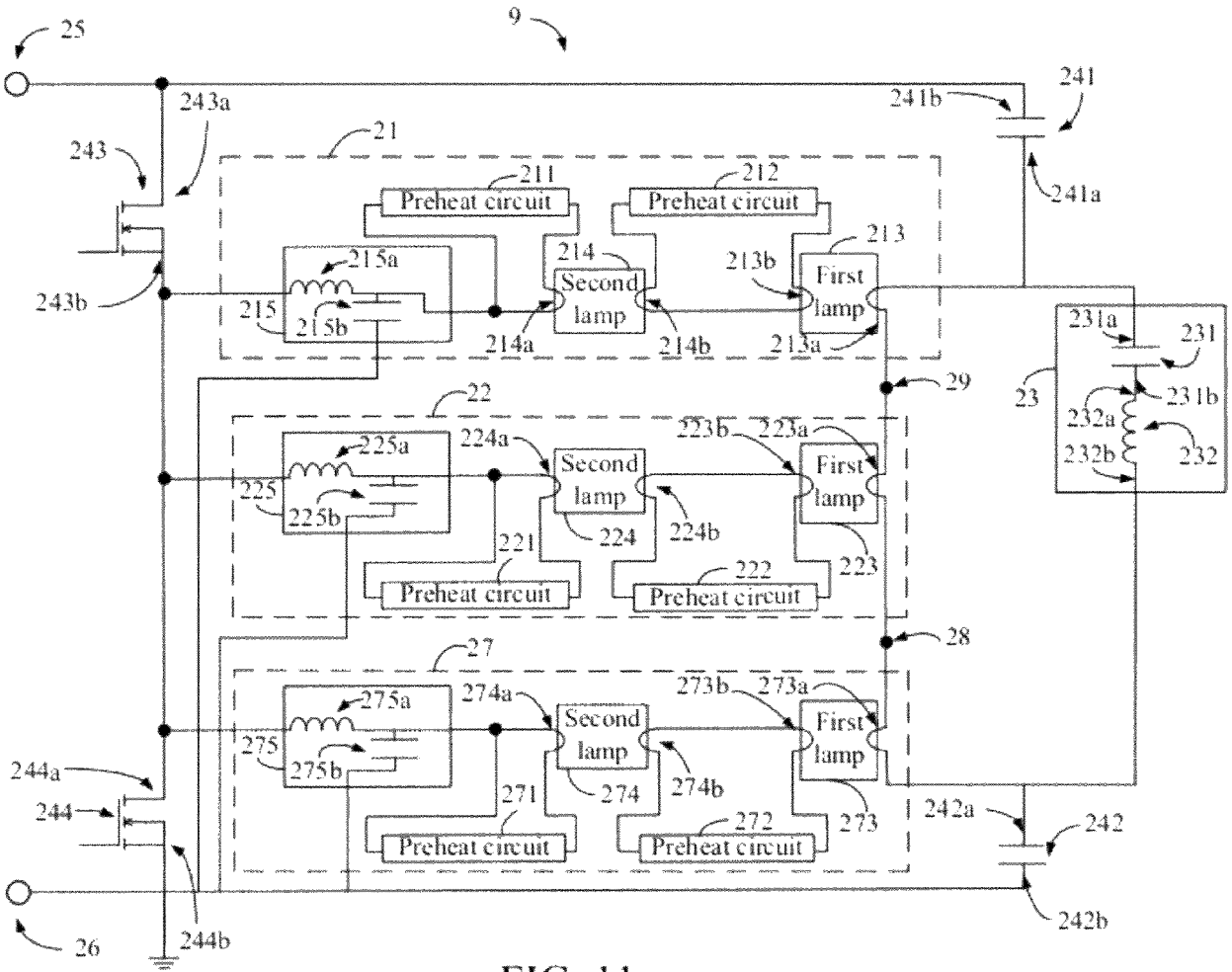
FIG. 11 is a schematic view of an eighth preferred embodiment of the present invention.

An eighth preferred embodiment of the present invention is illustrated in FIG. 11, which is a schematic view of a ballast 9. Two primary differences exist between the ballast 9 and the ballast 2. The first difference lies in that the ballast 9 comprises a third lamp set 27 in addition to a switch circuit, a first lamp set 21, a second lamp set 22, a preheat circuit 23, a first input terminal 25, and a second input terminal 26.

The first lamp set 21, the second lamp set 22, and the third lamp set 27 are connected to each other in parallel and arranged in the arrangement sequence: the first lamp set 21, the second lamp set 22, and the third lamp set 27 in sequence.

Particularly, the third lamp set 27 comprises a first lamp 273, a second lamp 274, a resonant circuit 275, and preheat circuits 271, 272. The first lamp 273 has a first filament 273*a* and a second filament 273*b*, and the second lamp 274 has a first filament 274*a* and a second filament 274*b*. The first filament 274*a* of the second lamp 274 is connected to the resonant circuit 275 and the second filament 274*b* of the second lamp 274 is connected to the second filament 273*b* of the first lamp 273, so that the resonant circuit 275, the second lamp 274, and the first lamp 273 are connected in series. Particularly, the resonant circuit 275 comprises a resonant inductor 275*a* and a resonant capacitor 275*b*, and both of them are coupled to the first filament 274*a* of the second lamp 274. By having the connection relations, the resonant circuit 275 is able to start the first lamp 273 and the second lamp 274 of the third lamp set 27. The preheat circuit 271 is connected to the resonant circuit 275 and the first filament 274*a* of the second lamp 274 to preheat the first filament 274*a* before the second lamp 274 is started. The preheat circuit 272 is connected between the second filament 273*b* of the first lamp 273 and the second filament 274*b* of the second lamp 274 to preheat the second filaments 273*b*, 274*b* before the first lamp 273 and the second lamp 274 are started.

The second difference between the ballast 9 and the ballast 2 lies in the connection manner of the first filaments 213*a*, 223*a*, 273*a* of the first lamps 213, 223, 273. The first filaments 213*a*, 223*a*, 273*a* are connected in series according to the aforementioned arrangement sequence to form junctions 29, 28 at the series connection points. Specifically, the first filament 213*a* and the first filament 223*a* are connected to each other in series to form the junction 29; and the first filament 223*a* and the first filament 273*a* are connected to each other in series to form the junction 28. Furthermore, the first filament 213*a* (i.e., the first one of the first filaments 213*a*, 223*a*, 273*a*) is coupled to the first switch 243, and the first filament 273*a* (i.e., the last one of the first filaments 213*a*, 223*a*, 273*a*) is coupled to the second switch 244. By having the connection relations, the junctions 29, 28 are indirectly connected to the first switch 243, the second switch 244, the first capacitor 241 and the second capacitor 242 via the first filaments 213*a*, 223*a*, 273*a*.

With the aforementioned arrangements, when a ballast comprises more than two lamp sets, use of internal connection terminals and wires can be reduced to save more space within the ballast as well.

Figure 12:
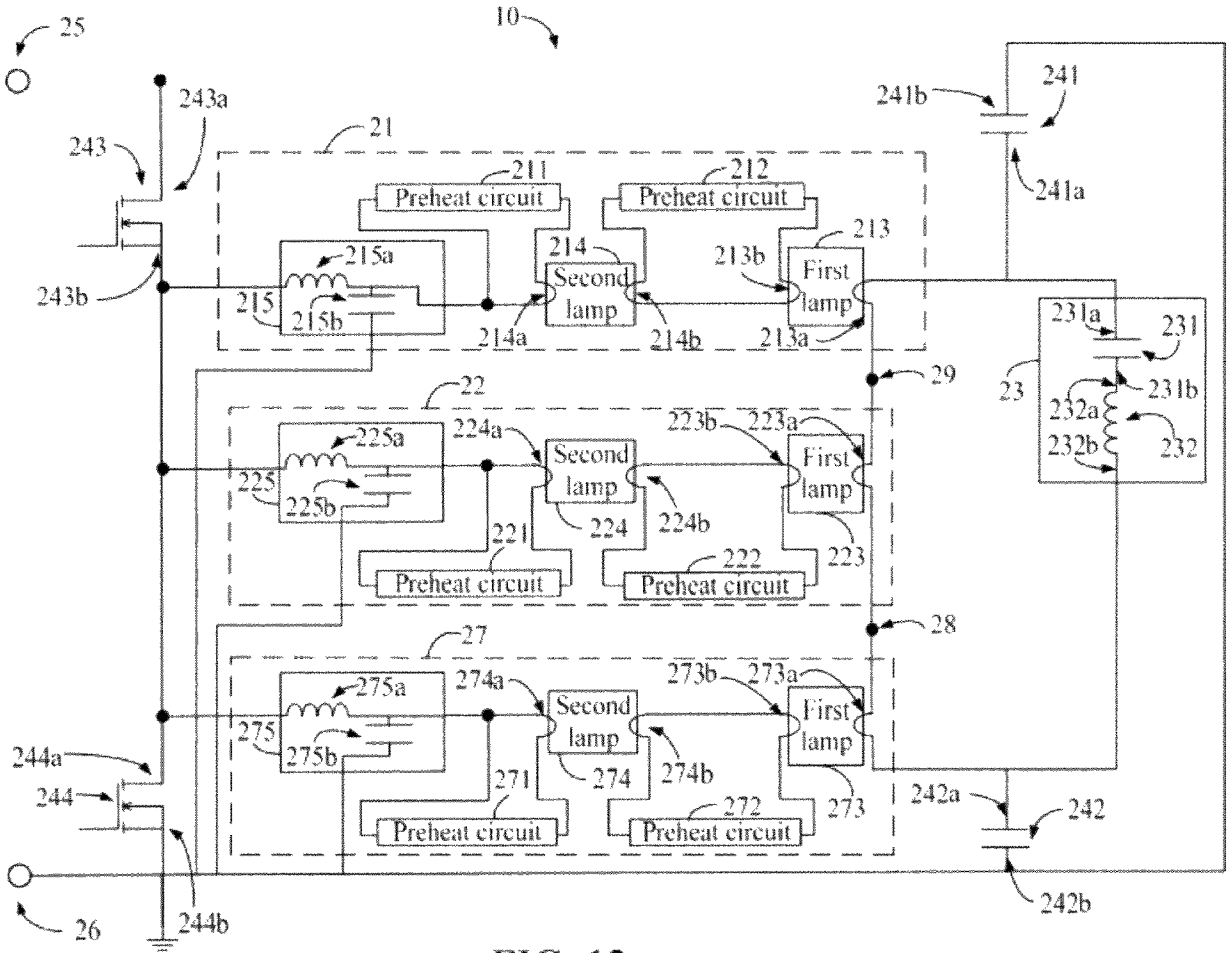
FIG. 12 is a schematic view of a ninth preferred embodiment of the present invention.

A ninth preferred embodiment of the present invention is illustrated in FIG. 12, which is a schematic view of a ballast 10. The ballast 10 is different from the ballast 9 in respect of the switch circuit. The following description will focus on differences between the ballast 10 and the ballast 9, and descriptions related of the identical portions will be omitted.

The switch circuit of the ballast 10 comprises a first capacitor 241, a second capacitor 242, a first switch 243, and a second switch 244. The ballast 10 is different from the ballast 9 in respect of the connection manner of the first capacitor 241. Specifically, the second terminal 241*b* of the first capacitor 241 of the ballast 10 is connected to the second terminal 242*b* of the second capacitor 242 and the second switch 244 instead of the first switch 243. The connection manners of the switch circuit of the ballast 10 make the ballast 10 provide the same functions and properties as the ballast 9.

By changing the connection manner of the lamps and the preheat circuits, the ballast of the present invention saves use of internal connection terminals and wires to free more internal space within the ballast. Therefore, the problem that a conventional ballast uses too many internal connection terminals and wires is effectively overcome by the ballast of the present invention.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A ballast, comprising:

a first input terminal;

a second input terminal;

a switch circuit comprising a first switch and a second switch, a first terminal of the first switch being connected to the first input terminal, a second terminal of the first switch being connected to a first terminal of the second switch, and a second terminal of the second switch being connected to the second input terminal; and a plurality of lamp sets being connected to each other in parallel and having an arrangement sequence, each of the lamp sets being coupled to the first switch and the second switch and comprising:

a first lamp, including a first filament;

wherein the first filaments are connected in series according to the arrangement sequence to form at least one junction at the series connection point, the first one of the first filaments is coupled to the first switch, the last one of the first filaments is coupled to the second switch so that the at least one junction is connected to the switch circuit indirectly via a part of the first filaments.

2. The ballast as claimed in claim 1, wherein the switch circuit further comprises a first capacitor having a first terminal and a second terminal, the first terminal of the first capacitor is connected to the first one of the first filaments, and the second terminal of the first capacitor is connected to one of the first input terminal and the second input terminal.

3. The ballast as claimed in claim 2, wherein the switch circuit further comprises a second capacitor having a first terminal and a second terminal, the first terminal of the second capacitor is connected to the last one of the first filaments and the second terminal of the second capacitor is connected to the second terminal of the second switch so that each of the lamp sets is connected to the second switch via the second capacitor.

4. The ballast as claimed in claim 3, wherein each of the lamp sets further comprises a resonant circuit being configured to start the first lamp of the corresponding lamp set.

5. The ballast as claimed in claim 4, wherein each of the lamp sets further comprises:

a second lamp having a first filament and a second filament, the first filament being connected to the resonant circuit, the second filament being connected to a second filament of the corresponding first lamp so that the second lamp is connected to the corresponding first lamp and the resonant circuit in series;

wherein each of the resonant circuits is further configured to start the corresponding second lamp.

6. The ballast as claimed in claim 5, wherein each of the resonant circuits comprises:

a resonant inductor being connected to the first switch, the second switch, and the first filament of the corresponding second lamp; and a resonant capacitor being connected to the resonant inductor, the first filament of the corresponding second lamp, the second input terminal, and the second terminal of the second capacitor.

7. The ballast as claimed in claim 5, wherein the resonant circuits comprise:

a common resonant inductor having a first terminal and a second terminal, the first terminal of the common resonant inductor being connected to the second terminal of the first switch and the first terminal of the second switch;

a common resonant capacitor having a first terminal and a second terminal, the first terminal of the common resonant capacitor being connected to the second terminal of the common resonant inductor, and the second terminal of the common resonant capacitor being connected to the second input terminal; and a plurality of independent resonant capacitors, each of the independent resonant capacitors having:

a first terminal being connected to the second terminal of the common resonant inductor and the first terminal of the common resonant capacitor; and a second terminal being connected to the second lamp of one of the lamp sets.

8. The ballast as claimed in claim 1, further comprising a preheat circuit connected in parallel with the first filaments.

9. The ballast as claimed in claim 8, wherein the preheat circuit comprises:

a preheat capacitor; and at least one inductor being connected in series with the preheat capacitor.

10. The ballast as claimed in claim 1, further comprising:

at least one preheat circuit having a first terminal and a second terminal, the first terminal of the at least one preheat circuit being coupled to the first switch and the second switch and the second terminal of the at least one preheat circuit being connected to one of the first filaments directly, so that the at least one junction is connected to the switch circuit indirectly via one of the at least one preheat circuit and the part of the first filaments.

11. The ballast as claimed in claim 10, wherein the switch circuit further comprises a first capacitor having a first terminal and a second terminal, the first terminal of the first capacitor is connected to the preheat circuit, and the second terminal of the first capacitor is connected to one of the first switch and the second switch.

12. The ballast as claimed in claim 11, wherein the switch circuit further comprises a second capacitor having a first terminal and a second terminal, the first terminal of the second capacitor is connected to the preheat circuit, and the second terminal of the second capacitor is connected to the second switch.

13. The ballast as claimed in claim 12, wherein each of the lamp sets further comprises a resonant circuit being configured to start the corresponding first lamp.

14. The ballast as claimed in claim 13, wherein each of the lamp sets further comprises:

a second lamp having a first filament and a second filament, the first filament is connected to the resonant circuit and the second filament is connected to a second filament of the corresponding first lamp so that the first lamp, the second lamp and the resonant circuit are connected in series;

wherein each of the resonant circuits is further configured to start the corresponding second lamp.

15. The ballast as claimed in claim 14, wherein each of the resonant circuits comprises:

a resonant inductor being connected to the first switch, the second switch, and a first filament of the corresponding second lamp; and a resonant capacitor being connected to the resonant inductor, the first filament of the corresponding second lamp, the second input terminal, and the second terminal of the second capacitor.

16. The ballast as claimed in claim 14, wherein the resonant circuits comprise:

a common resonant inductor having a first terminal and a second terminal, the first terminal of the common resonant inductor being connected to the second terminal of the first switch and the first terminal of the second switch;

a common resonant capacitor having a first terminal and a second terminal, the first terminal of the common resonant capacitor being connected to the second terminal of the common resonant inductor, and the second terminal of the common resonant capacitor being connected to the second input terminal; and a plurality of independent resonant capacitors, each of the independent resonant capacitors having:

a first terminal being connected to the second terminal of the common resonant inductor and the first terminal of the common resonant capacitor; and a second terminal being connected to the second lamp of one of the lamp sets.

17. The ballast as claimed in claim 10, wherein the preheat circuit comprises:

at least one inductor having a first terminal and a second terminal; and a preheat capacitor having a first terminal and a second terminal, and the first terminal of the preheat capacitor being connected to the first terminal of the at least one inductor.

18. The ballast as claimed in claim 10, further comprising a plurality of preheat circuits, each of the preheat circuits corresponding to one of the lamp sets and having a first terminal and a second terminal, the first terminals being coupled to the switch circuit, and each of the second terminals is connected to the corresponding first filaments directly.

* * * * *